US008016157B2

(12) United States Patent
Norris et al.

(10) Patent No.: US 8,016,157 B2
(45) Date of Patent: Sep. 13, 2011

(54) DISPENSER

(76) Inventors: Joseph Thomas Norris, West Windsor, NJ (US); Jeffrey Mayers, Ridgefield Park, NJ (US); Peter Stagl, Morris Plains, NJ (US)

( * ) Notice: Subject to any disclaimer, the term of this patent is extended or adjusted under 35 U.S.C. 154(b) by 126 days.

(21) Appl. No.: 11/271,591

(22) Filed: Nov. 10, 2005

(65) Prior Publication Data

US 2007/0102442 A1 May 10, 2007

(51) Int. Cl.
*B65H 39/00* (2006.01)
*B67D 7/00* (2010.01)

(52) U.S. Cl. ..... 221/286; 221/197; 221/199; 221/282; 221/287; 221/97; 222/131; 426/86; 426/394

(58) Field of Classification Search ..... 221/1–312 C; 220/23.91; 222/325, 131; 271/177; 426/86, 426/394

See application file for complete search history.

(56) References Cited

U.S. PATENT DOCUMENTS

| | | | | | |
|---|---|---|---|---|---|
| 2,102,244 | A * | 12/1937 | Walsh | 99/315 |
| 3,246,815 | A * | 4/1966 | Aronson | 225/44 |
| 3,285,461 | A | 11/1966 | Santelli | |
| 3,464,599 | A * | 9/1969 | Meth | 222/589 |
| 4,535,912 | A * | 8/1985 | Bonk | 221/46 |
| 4,627,334 | A * | 12/1986 | Shanklin | 99/306 |
| 4,984,723 | A * | 1/1991 | Hsu | 224/148.4 |
| 5,289,949 | A * | 3/1994 | Gentile | 222/137 |
| 5,509,571 | A * | 4/1996 | Weber | 221/46 |
| 5,549,381 | A * | 8/1996 | Hays et al. | 366/139 |
| 5,653,436 | A * | 8/1997 | Zouzoulas | 271/177 |
| 5,758,797 | A * | 6/1998 | Martindale | 220/719 |
| 6,089,397 | A * | 7/2000 | Van Melle | 220/270 |
| 6,158,614 | A * | 12/2000 | Haines et al. | 221/63 |
| 6,180,149 | B1 * | 1/2001 | Gramm | 426/394 |
| 6,446,827 | B1 * | 9/2002 | Akins | 220/570 |
| 6,547,104 | B1 * | 4/2003 | Wilkinson | 222/192 |
| 6,814,990 | B2 * | 11/2004 | Zeng | 426/86 |
| 6,832,682 | B1 * | 12/2004 | Foster et al. | 206/219 |
| 6,923,347 | B2 | 8/2005 | Winckels | |
| 7,032,775 | B1 * | 4/2006 | Almeer et al. | 221/56 |
| 2002/0036180 | A1 * | 3/2002 | Jimenez et al. | 215/277 |
| 2004/0245708 | A1 * | 12/2004 | Takeuchi | 271/177 |

* cited by examiner

*Primary Examiner* — Michael K Collins
(74) *Attorney, Agent, or Firm* — Judy W. Chung

(57) ABSTRACT

The dispenser is comprised of a first hollow body and a second hollow body. The second hollow body fits into the first hollow body. The second hollow body has a closure at the open end. The second hollow body is maintained in the first hollow body by means of an interference fit. There also is at least one vent between the first hollow body and the second hollow body. The second hollow body will contain a medicament. In use the first hollow body and the second hollow body are separated, the lid on the closure of the second hollow body opened and a tablet dispensed into the first hollow body. A liquid such as water is added to the first hollow body to dissolve the tablet. This dissolved medicament is ingested in the usual way and the second hollow body placed back into the first hollow body.

20 Claims, 5 Drawing Sheets

DISPENSER

This invention is directed to a personal dispenser for a medicament which dispenser provides for the storage of the medicament and a cup for the use of the medicament. More particularly this invention relates to a combined holder for storing medicament tablets and a cup for dissolving the tablet and then ingesting the dissolved tablet.

BACKGROUND OF THE INVENTION

There is a need for compact dispensers for various medicaments. This particularly is the case for medicaments that are to be utilized away from home. Such medicaments include prescription and over the counter medicines, and mouthwashes. People with periodontal problems need to cleanse their mouth several times a day, and particularly after meals. The result is that there is needed a dispenser that includes a container holder for the mouthwash and a cup for providing an appropriate dose of mouthwash. The present invention solves this problem with a compact dispenser that has a combined cup that is versatile for home or away from home use.

The prior art is comprised of composite receptacles where the inner receptacle contains a product and the outer receptacle provides protection and receptacles where both the inner and the outer receptacle are involved in the use of the product. In the prior category are the receptacles of U.S. Pat. No. 3,285,461 and U.S. Patent Application 2002/0036180. Each discloses an outer unit that structurally protects an inner unit. In the latter category is U.S. Pat. No. 6,814,990 directed to a beverage system. This beverage system is comprised of a pitcher and a container to hold the packets of drink concentrate. The inner container has no closure with only the outer container having a closure. In use the outer pitcher is opened and the inner container is removed from the outer pitcher. A packet of drink concentrate is placed in the pitcher and water is added. The pitcher then will contain several servings of the beverage to be dispensed into individual cups. The pitcher closure can be rotated to enclose or to dispense the beverage. This structure has several problems. First, during the time that the pitcher is in use the inner container is left opened. Second, the inner container is not separate from the pitcher when nested so any moisture remaining in the pitcher can be absorbed by the product in the inner container. This structure also allows for other contamination of the product in the inner container.

The structure of the present dispenser provides for separate serving use and maintains the product in the second hollow body in an enclosed environment at all times except for the dispensing of the tablet or capsules into the first hollow body which in intended use is the drinking cup. It provides for a convenient away from home use as well as an at home use.

SUMMARY OF THE INVENTION

The dispenser is comprised a first hollow body and a second hollow body, the second hollow body fitting into the first hollow body. The second hollow body has a closure with a lid, the lid covering an aperture from which the contents of the second hollow body can be dispensed. The contents of the second hollow body are dispensed into the first hollow body for use. The second hollow body is in an interference fit into the first hollow body whereby the second hollow body is maintained within the first hollow body. The interference fit is comprised of a projection and a recess, with one being on the inner surface of the first hollow body and the other being on the outer surface of the second hollow body. There is at least one vent to permit moisture to be dissipated from the first hollow body, wherein the vent is a space between a wall of the first hollow body and a wall of the second hollow body, the space preferably is between a sidewall of the first hollow body and a sidewall of the second hollow body. The contents of the second hollow body are medicaments, including mouthwashes.

In addition there is a method of providing a medicament for treating a person comprising providing a first hollow body and a second hollow body, a second hollow body fitted into the first hollow body. The second hollow body has a closure with a lid, the lid covering an aperture from which the contents of the second hollow body can be dispensed. A quantity of a medicament contained in the second hollow body is dispensed by removing the second hollow body from the first hollow body, and in either order placing a portion of the medicament into the first hollow body and adding a liquid to at least partially dissolve the medicament, or adding a liquid to the second hollow body to at least partially dissolve the medicament and then adding the medicament, whereby there is provided a medicament in a form ready for use. The contents of the second hollow body are prescription or over the counter medicaments, including mouthwashes.

DETAILED DESCRIPTION OF THE INVENTION

Figure 1:
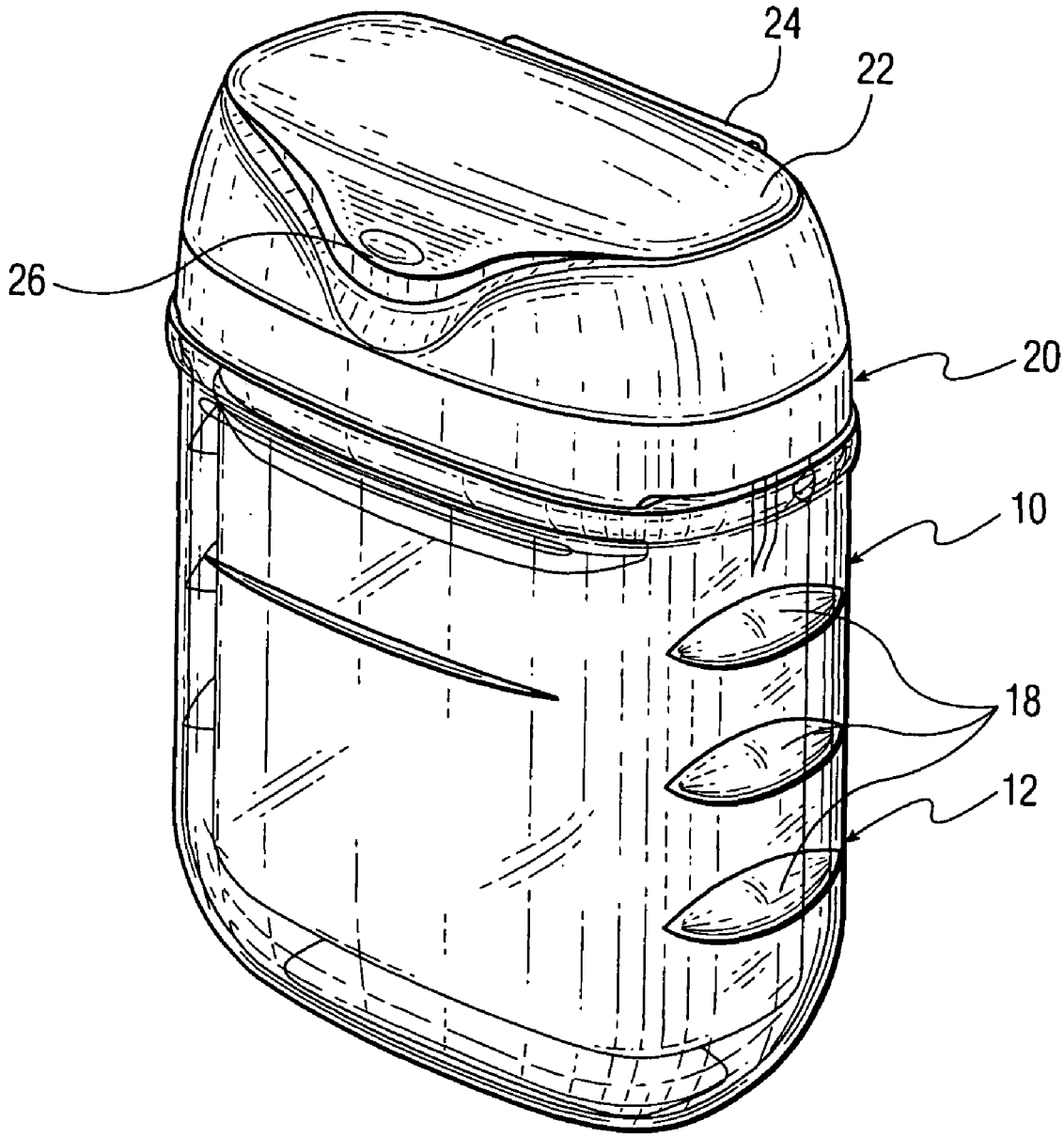
FIG. 1 is a perspective view of the dispenser.

The invention will be described in more detail in its preferred embodiments with reference to the figures in the drawings. The invention may be modified in various aspects, however all such modifications are within the present concept.

FIG. 1 is a perspective view of the dispenser 10. The dispenser is comprised of first hollow body 12, a second hollow body 30, and closure 20 which is on second hollow body 30 (see FIG. 2). The closure has a lid 22 which is connected to the closure 20 by hinge 24. The lid 22 can be opened by the grip tab 26. The dispenser 10 is shown in more detail in the exploded view of FIG. 2.

Figure 2:
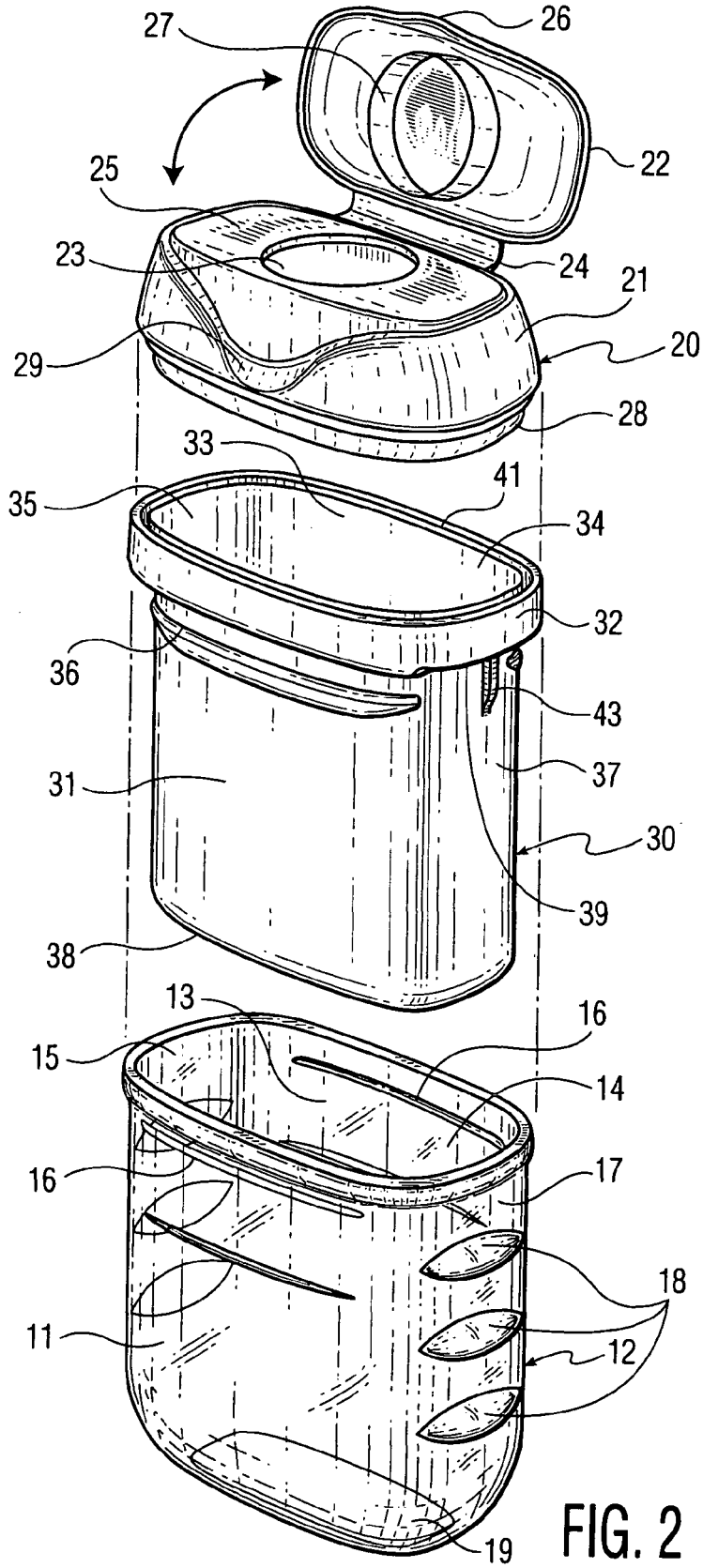
FIG. 2 is an exploded view of the dispenser.

In FIG. 2 there is shown first hollow body 12 with front surface 11, rear surface 13, left side surface 15 and right side surface 17. The first hollow body 12 is open at the top 14 and is closed at the bottom 19. Side surfaces 15, 17 have grips 18. Front surface 11 and rear surface 13 have parts of the mechanism for the interference fit of the second hollow body 30 into the first hollow body 12. In this embodiment the interference fit parts are recesses 16 on first hollow body 12. These interfit with projections 36 on the front surface 31 and the rear surface 33 of the second hollow body 30. However the recesses can be on the second hollow body 30 and the projections on the first hollow body 12. Either orientation will produce an interference fit. There are yet many other known ways to produce an interference fit of one hollow body into another.

The second hollow body 30 has an open top 34 and a closed bottom surface 38. On each side there is a spacer 43. These spacers will maintain a space between the sidewalls 15, 17 of the first hollow body 12 and the sidewalls 35, 37 of the second hollow body 30. The top ridge flange 32 of the second hollow body has a recess 39 adjacent each sidewall 35, 37. When the second hollow body 30 is fitted into the first hollow body 12 the recesses 39 provide a vent of the space between the first hollow body 12 and the second hollow body 30. Air can pass into and out of the space between the first hollow body 12 and the second hollow body 30, to promote the evaporation of any moisture to occur.

The closure 20 has a base 21 and a lid 22 with a hinge 24 connecting the lid to the base. The base 21 has an interference fit portion 28 on a lower part to interfit with interference fit portion 41 on the second hollow body 30. The base has an upper surface 25 with a dispensing aperture 23. The front surface of the closure has recess 29 to accept the grip tab 26 when the lid is closed. The inner surface of the lid 22 has a projecting cylinder 27 which interfits into aperture 23 of closure 20 when the lid is closed. This interfitting will also produce an interference fit of the cylinder 27 into aperture 23 sufficient to maintain the lid in a closed position.

Figure 3:
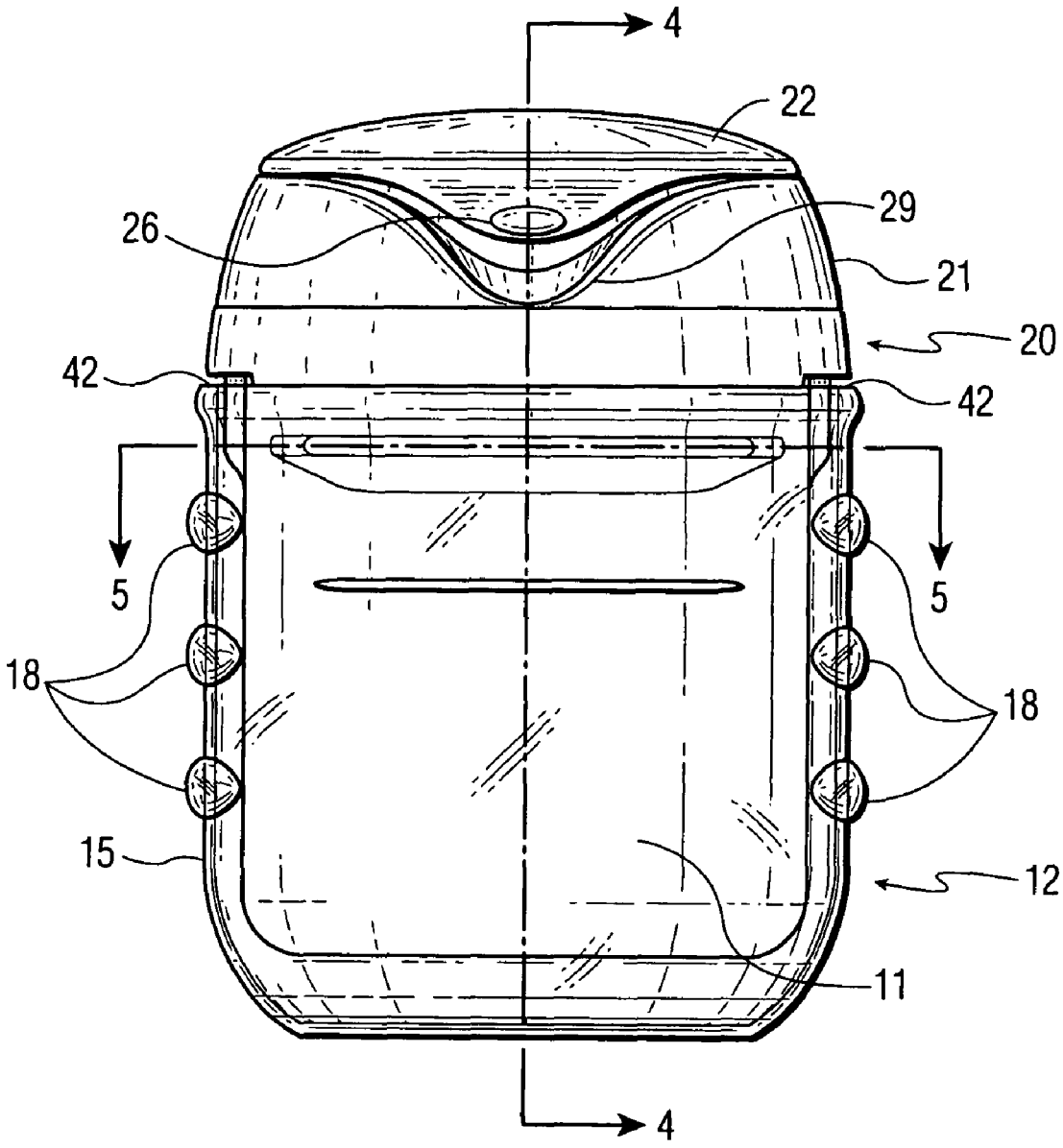
FIG. 3 is a front elevation view of the dispenser.

FIG. 3 is a front elevation view of the dispenser. This view shows the both side surfaces 15, 17 of the first hollow body 12. Also shown are the grips 18 on each side 15, 17 to facilitate the removal and the replacement of the second hollow body. In addition there is shown the vent opening 42 from the space between the first hollow body 12 and the second hollow body 30. The recess 39 (see FIG. 2) on the flange 32 provides this vent opening. The remaining parts of FIG. 3 are shown in FIG. 1.

Figure 4:
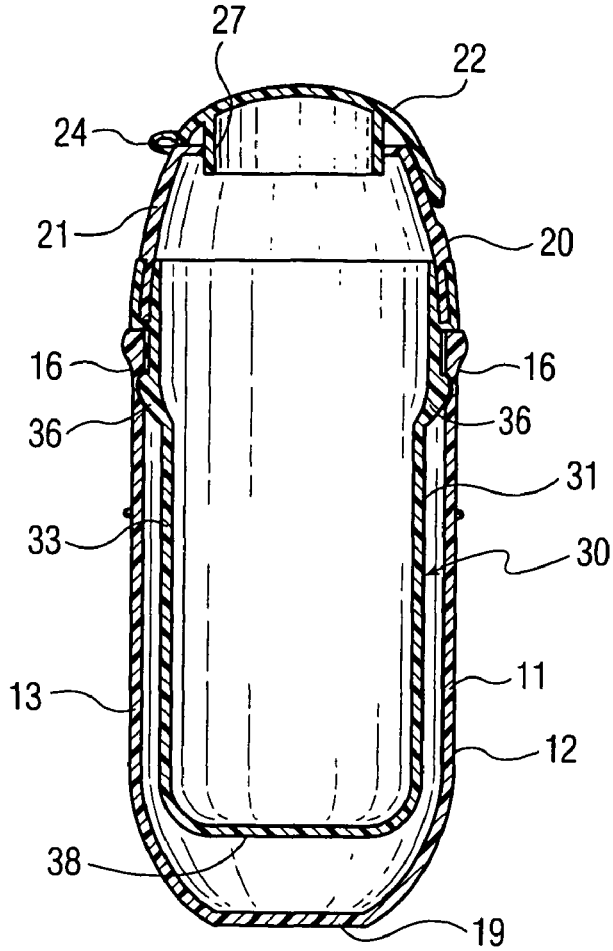
FIG. 4 is a vertical cross-section of the dispenser along line 4-4 of FIG. 3.

FIG. 4 is a vertical cross-section along line 4-4 of FIG. 3. There is shown second hollow body 30 in first hollow body 12. The first hollow body has front surface 11, rear surface 13 and bottom surface 19. On an upper part of the front surface 11 and the rear surface 13 there is projection 16 for the purpose of providing an interference fit with the second hollow body 30. On the uppermost part of hollow body 12 is closure 20. This is comprised of base 21, lid 22, hinge 24 and cylinder 27 which interfits into aperture 23 of the base 21. The second hollow body 30 is comprised of front surface 31, rear surface 33 and bottom surface 38. Interference fit projection 36 is on the outer front and rear surfaces. This projection 36 co-acts with recess 16 on the first hollow body inner front and rear surfaces.

Figure 5:
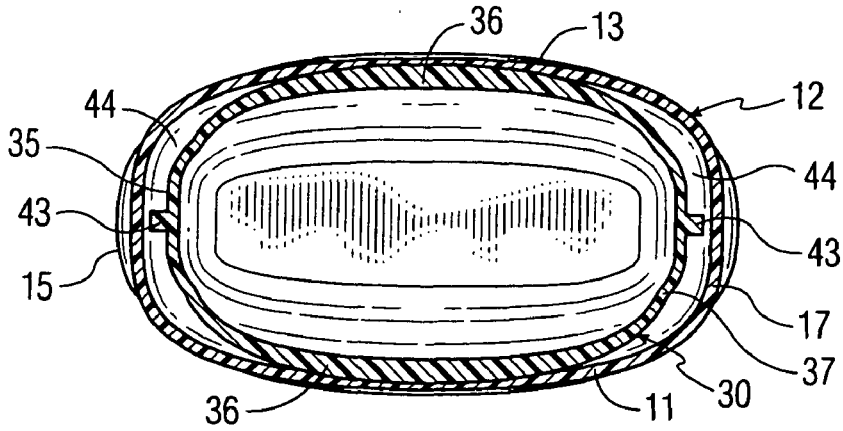
FIG. 5 is a horizontal cross-section of the dispenser of FIG. 3 along line 5-5.

FIG. 5 is a horizontal cross-sectional view of the dispenser of FIG. 3. This view shows the front surface 11, rear surface 13 and side surfaces 15 and 17 of the first hollow body 12 along with a space 44 between the first hollow body and the second hollow body. On the second hollow body 30 this view shows sidewalls 35 and 37 and spacer 43 on these sidewalls. The projection 36 is shown on the front wall and the rear wall of the second hollow body 30.

Figure 6:
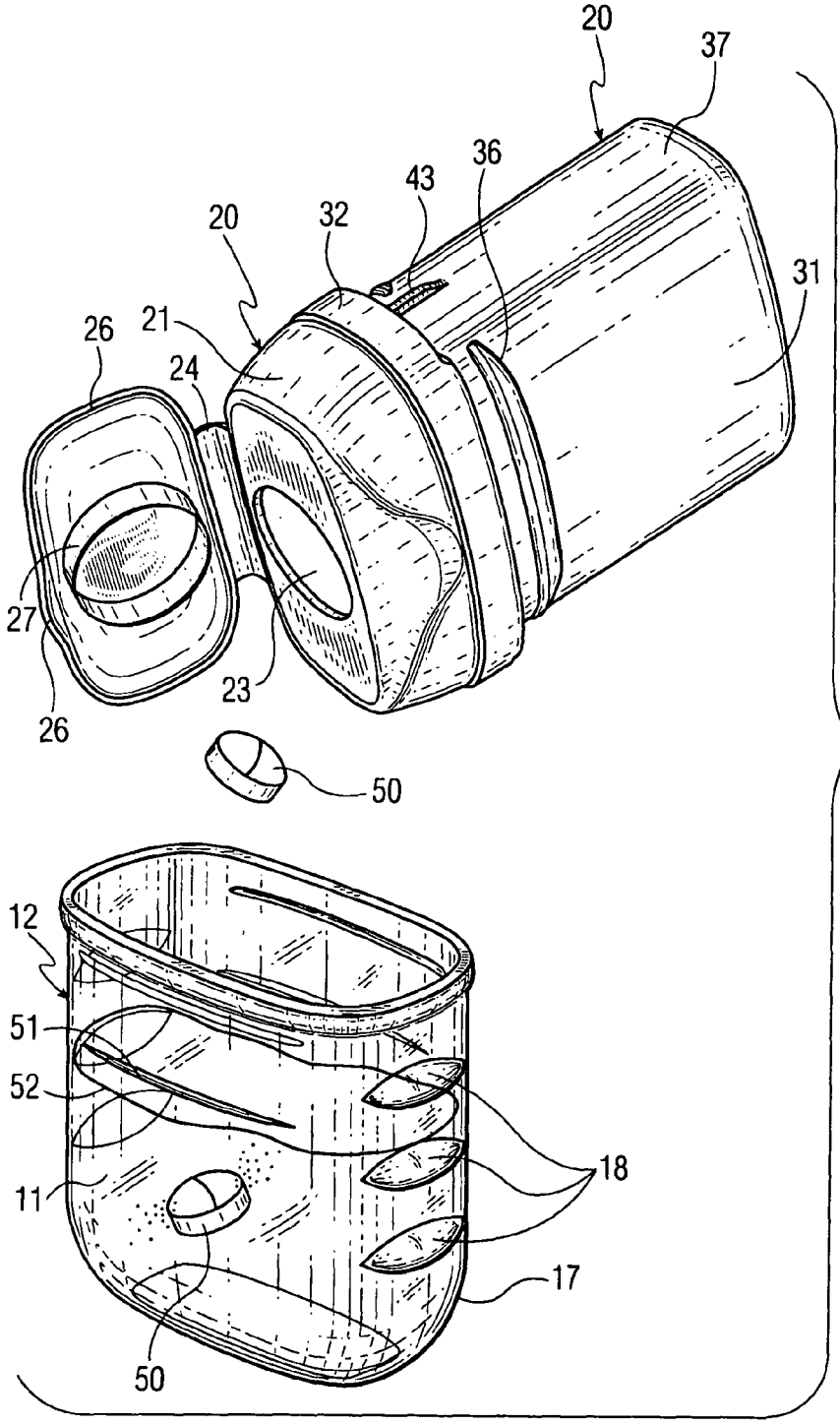
FIG. 6 is an illustration of the dispenser being used.

FIG. 6 shows the dispenser 10 being used. The dispenser parts will not be discussed in detail since they have been fully described in the prior figures. In use the second hollow body 30 is removed from the first hollow body 12 and at least partially filled with a liquid 52 to at least partially dissolve the tablet 50. Projection 51 is a convenient fill line to be used when filling the first body 20 with a liquid. The tablet 50 is dispensed from second hollow body 30 by opening lid 26 on closure 20. One or more tablets can be added to the water in first hollow body 12. Upon the dissolution of the tablet(s), which here are mouthwash tablets, the liquid is ingested into the mouth and the mouth rinsed as with any conventional mouthwash. The lid 26 then is closed and second hollow body 30 placed back into the first hollow body 12. The dispenser can be used until all of the tablets have been dispensed.

The first hollow body, the second hollow body and the closure are injection molded using a thermoplastic resin. The resin can predominantly be an olefinic polymer or copolymer such as ethylene, propylene, butene and butadiene polymers and copolymers as well as polyester polymer resins based on polyethylene terephthalate. The closure can likewise be predominantly an olefinic polymer or copolymer.

The tablet can be any medicament that needs to be at least partially dissolved in a liquid such as water. This includes antacids, various prescription drugs and mouthwashes. The preferred medicaments for which it is to be used are mouth washes.

We claim:

1. A dispenser to deliver a dose of a liquid substance comprising:

a first hollow body, a second hollow body, the first hollow body having a structure to contain the liquid substance, the second hollow body having an open top, and a top ridge flange defining at least a portion of said open top, the top ridge flange further having first and second recesses disposed adjacent to first and second sidewalls of the second hollow body, respectively;

the second hollow body fitting directly into the first hollow body and forming a closure for the first hollow body, the second hollow body having a closure and a closed bottom surface so that the liquid substance does not enter the second hollow body, the closure of the second hollow body having a lid, and the lid covering an aperture in the second hollow body closure from which the contents of the second hollow body can be dispensed into the first hollow body for dilution and subsequent ingestion by a person directly from the first hollow body;

wherein when the second hollow body is fitted into the first hollow body, the first and second recesses define vent paths between said top ridge flange and a top surface of said first hollow body, the vent paths connecting to a space between the first hollow body and the second hollow body to promote evaporation of moisture within the space.

2. A dispenser as in claim 1 wherein the lid is attached to the closure of the second hollow body by a hinge.

3. A dispenser as in claim 1 wherein the second hollow body is an interference fit into the first hollow body whereby the second hollow body is maintained within the first hollow body.

4. A dispenser as in claim 3 wherein the interference fit is comprised of a projection and a recess.

5. A dispenser as in claim 4 wherein the recess is on an inner surface of the first hollow body and the projection is on an outer surface of the second hollow body.

6. A dispenser as in claim 1 wherein at least one of the first and second recesses comprises a discontinuity in a lower surface of said top ridge flange, wherein said discontinuity forms at least one of the vent paths.

7. A dispenser as in claim 6 wherein at least a portion of at least one of the vent paths is defined by a wall of the first hollow body and a wall of the second hollow body.

8. A dispenser as in claim 7 wherein one of the vent paths is defined between a sidewall of the first hollow body and the first or second sidewall of the second hollow body.

9. A dispenser as in claim 8 wherein the second hollow body further comprises at least one spacer disposed on the first or second sidewall of the second hollow body below the top ridge flange, the spacer maintaining the space between the first hollow body and the second hollow body.

10. A dispenser as in claim 7 wherein the second hollow body further comprises at least one spacer disposed on the wall of the second hollow body to maintain the space between the first hollow body and second hollow body.

11. A dispenser as in claim 10 wherein the spacer is a projection on the wall of the second hollow body.

12. A dispenser as in claim 1 wherein the lid has a finger grip on an edge thereof.

13. A dispenser as in claim 1 wherein tablets are dispensed from the dispenser.

14. A dispenser as in claim 13 wherein the tablets are medicaments.

15. A dispenser as in claim 14 wherein the medicament is a mouthwash.

16. A method of providing a medicament in a liquid form for treating a person comprising:

providing a first hollow body and a second hollow body, the first hollow body being opens on one end and having a structure to contain the medicament in a liquid form, the second hollow body being fitted directly into the first hollow body forming a closure for the first hollow body, the second hollow body having a closure and a closed bottom surface so that the liquid substance does not enter the second hollow body, the second hollow body further having an open top, and a top ridge flange defining at least a portion of said open top, the top ridge flange further having first and second recesses disposed adjacent to first and second sidewalls of the second hollow body, respectively, wherein when the second hollow body is fitted into the first hollow body, the first and second recesses define vent paths between said top ridge flange and a top surface of said first hollow body, the vent paths connecting to a space between the first hollow body and the second hollow body to promote evaporation of moisture within the space;

the closure of the second hollow body having an aperture from which the contents of the second hollow body can be dispensed, a quantity of the medicament contained in the second hollow body, removing the second hollow body from the first hollow body, and in either order placing a portion of the medicament from the second hollow body into the first hollow body and adding a liquid to at least partially dissolve the medicament in the first hollow body whereby there is provide the medicament in a liquid form ready for ingestion by a person directly from the first hollow body.

17. A method as in claim 16 wherein the medicament in the second hollow body is in the form of a tablet.

18. A method as in claim 17 wherein the medicament in the at least partially dissolved form is a mouthwash.

19. A method as in claim 18 wherein the liquid is water.

20. A method as in claim 16 wherein after use of the first hollow body the second hollow body is placed back into the first hollow body.

* * * * *